US011456123B2

(12) United States Patent
Hoffmann et al.

(10) Patent No.: US 11,456,123 B2
(45) Date of Patent: Sep. 27, 2022

(54) SWITCHING DEVICE

(71) Applicant: TDK Electronics AG, Munich (DE)

(72) Inventors: Robert Hoffmann, Berlin (DE); Frank Werner, Berlin (DE); Peter Bobert, Falkensee (DE)

(73) Assignee: TDK ELECTRONICS AG, Munich (DE)

( * ) Notice: Subject to any disclaimer, the term of this patent is extended or adjusted under 35 U.S.C. 154(b) by 0 days.

(21) Appl. No.: 16/975,361

(22) PCT Filed: Feb. 26, 2019

(86) PCT No.: PCT/EP2019/054760
§ 371 (c)(1),
(2) Date: Aug. 24, 2020

(87) PCT Pub. No.: WO2019/166445
PCT Pub. Date: Sep. 6, 2019

(65) Prior Publication Data

US 2020/0402732 A1 Dec. 24, 2020

(30) Foreign Application Priority Data

Feb. 27, 2018 (DE) ..... 102018104415.1

(51) Int. Cl.
*H01H 1/025* (2006.01)
*H01H 50/02* (2006.01)
*H01H 50/54* (2006.01)

(52) U.S. Cl.
CPC ..... *H01H 1/025* (2013.01); *H01H 50/023* (2013.01); *H01H 50/54* (2013.01); *H01H 2050/025* (2013.01)

(58) Field of Classification Search
CPC ..... H01H 1/025; H01H 1/0233; H01H 1/021; H01H 33/182; H01H 33/22; H01H 33/78;
(Continued)

(56) References Cited

U.S. PATENT DOCUMENTS 4,399,339 A * 8/1983 Storm ..... H01H 1/02 200/264
4,818,634 A * 4/1989 Bliss ..... B32B 15/015 148/326
(Continued)

FOREIGN PATENT DOCUMENTS

CN 1519991 A 8/2004
DE 3430490 C2 9/1987
(Continued)

OTHER PUBLICATIONS

Abderrazak Daoud, et al., "Effect of Temperature on the Low Cycle Fatigue Behavior of Glidcop AI-15," Science Direct, Procedia Engineering 2, www.sciencedirect.com, Mar. 15, 2010, 9 pages.
(Continued)

*Primary Examiner* — William A Bolton
(74) *Attorney, Agent, or Firm* — Slater Matsil, LLP

(57) ABSTRACT

A switching device is disclosed. In an embodiment a switching device includes at least one fixed contact and at least one movable contact, wherein at least one of the contacts includes a metal matrix composite material having a metallic matrix material and a filler dispersed within the matrix material, and wherein the contacts are arranged in a switching chamber with a gas and the gas contains H2.

23 Claims, 3 Drawing Sheets

(58) Field of Classification Search
CPC ..... H01H 50/023; H01H 50/54; H01H 50/38; H01H 51/065; H01H 51/56; H01H 1/04
USPC ..... 218/146, 16, 30, 48, 31; 200/264, 263, 200/262
See application file for complete search history.

(56) References Cited

U.S. PATENT DOCUMENTS 4,999,336 A * 3/1991 Nadkarni ..... B22F 1/0003 75/229
5,519,370 A 5/1996 Perreira et al.
5,589,652 A 12/1996 Arato et al.
5,701,993 A * 12/1997 Whitlow ..... C22C 1/0425 200/264
5,853,083 A * 12/1998 Furusawa ..... H01H 1/0206 200/264
6,210,809 B1 * 4/2001 Okutomi ..... H01H 1/0203 200/264
7,132,172 B2 11/2006 Buresch et al.
7,842,274 B2 * 11/2010 Goia ..... H01R 13/03 423/604
9,224,558 B2 12/2015 Gerving et al.
2015/0069020 A1 * 3/2015 Steinwandel ..... H01H 11/048 218/146

FOREIGN PATENT DOCUMENTS

DE 69414902 T2 4/1999
DE 102012112202 A1 6/2014
JP 2006012729 A 1/2006

OTHER PUBLICATIONS

Liu, J., "Mechanical Properties Test of Glidcop and Thermal Structural Analysis of High-Heat-Load Components in SSRF," University of Science and Technology of China, A Dissertation for Master's Degree, May 2009, 78 pages total, emphasis on pp. 12-15.

* cited by examiner

SWITCHING DEVICE

This patent application is a national phase filing under section 371 of PCT/EP2019/054760, filed Feb. 26, 2019, which claims the priority of German patent application 102018104415.1, filed Feb. 27, 2018, each of which is incorporated herein by reference in its entirety.

TECHNICAL FIELD

The invention specifies a switching device.

BACKGROUND

The switching device is in particular designed as a remotely operated, electromagnetically acting switch which can be operated by electrically conductive current. The switching device can be activated via a control circuit and can switch a load circuit. The switching device can in particular be designed as a relay or as a contactor, in particular as a power contactor. The switching device may particularly preferably be designed as a gas-filled power contactor.

One possible application for such switching devices, in particular power contactors, is the opening and isolation of battery circuits, for example in motor vehicles such as electrically or partially electrically driven motor vehicles. These may for example be purely battery-operated vehicles (BEV: "battery electric vehicle"), hybrid electric vehicles which can be charged via an outlet or charging station (PHEV: "plug-in hybrid electric vehicle") and hybrid electric vehicles (HEV). In general here, both the positive and the negative contacts of the battery are isolated using a power contactor. This disconnection is performed in normal operation for example when the vehicle is at rest and also in the event of a disturbance such as an accident or the like. The main task of the power contactor here is to switch the vehicle to a deenergized state and to interrupt the flow of current.

A particularly serious fault which can occur with such a switch is what is known as a "stuck contactor". In this case, switching elements "stick" together as a result of welding during a disconnection or connection operation, so that, even though the supply voltage to the switch has been disconnected, no reliable isolation of the load circuit can be guaranteed.

Document DE 34 30 490 C2 describes a contactor in which the use of tungsten or molybdenum in copper improves the erosion properties and reduces the tendency toward welding. However, these materials are laborious and costly to produce and result in the closed state of the switch in an increased contact resistance, which for example is generally undesirable in high-current applications.

Silver alloys and silver metal oxide alloys, for example AgCdO or AgSnO, are used in order to reduce the tendency toward welding in open contactors. However, these compounds are unsuitable in a hydrogen-containing atmosphere, as are used in gas-filled power contactors, on account of the not very stable oxide content, as there would be a reaction of the oxide with the hydrogen.

SUMMARY OF THE INVENTION

Embodiments provide a switching device, particularly preferably a switching device with which the tendency toward welding can be avoided or at least reduced.

In one embodiment, a switching device has at least one fixed contact and at least one movable contact. The at least one fixed contact and the at least one movable contact are provided and configured to open and close a load circuit which is connectable to the switching device. The movable contact is correspondingly movable in the switching device between a non-switched-through state and a switched-through state of the switching device in such a way that the movable contact in the non-switched-through state of the switching device is spaced apart from at least one fixed contact and is thus galvanically isolated and in the switched-through state has mechanical contact with at least one fixed contact and is thus galvanically connected to the at least one fixed contact. The switching device particularly preferably has at least two fixed contacts which are arranged in a manner separate from each other in the switching device and which in this way depending on the state of the movable contact can be electrically conductively connected to each other or electrically isolated from each other by the movable contact.

In a further embodiment, the switching device has a housing in which the movable contact and the at least one fixed contact or the at least two fixed contacts are arranged. The movable contact may in particular be arranged completely within the housing. That a fixed contact is arranged in the housing may mean in particular that the contact region of the fixed contact which is in mechanical contact with the movable contact in the switched-through state is arranged within the housing. For the connection of a supply line of a circuit to be switched by the switching device, a fixed contact arranged in the housing may be electrically contactable from the outside, that is to say from outside the housing. To this end, a fixed contact arranged in the housing may protrude out from the housing and outside of the housing possess the possibility of being connected to a supply line.

In a further embodiment, the contacts are arranged in a gas atmosphere in the housing. This can mean in particular that the movable contact is arranged completely within the gas atmosphere in the housing and that furthermore at least portions of the fixed contact or contacts, for instance the contact region or regions of the fixed contact or contacts, are arranged in the gas atmosphere in the housing. The switching device can correspondingly particularly preferably be a gas-filled switching device, such as for instance a gas-filled contactor. In particular, the contacts, that is to say the entirety of the movable contact and at least portions of the fixed contact or contacts, can be arranged in a switching chamber within the housing, the gas, that is to say at least a portion of the gas atmosphere, being situated in the switching chamber. The gas can preferably have a content of at least 50% $H_2$. In addition to $H_2$, the gas can include an inert gas, particularly preferably $N_2$ and/or one or more noble gases.

In a further embodiment, at least one of the contacts includes a metal matrix composite material comprising a metallic matrix material and a filler dispersed within the matrix material. The metal matrix composite material can particularly preferably include copper or a copper alloy as the matrix material. Such materials can advantageously have a high electrical conductivity and correspondingly a high current carrying capacity. The filler can particularly preferably include a metal oxide, especially a high-melting, very stable metal oxide. By way of example, the filler can include an oxide comprising aluminum. As an alternative or in addition to aluminum oxide, the filler can also include at least one or more other ceramic oxides.

In a further embodiment, the filler is formed of particles which may be distributed preferably uniformly and homogeneously in the matrix material. It has proven to be advantageous if the particles have an average size of less than 1 μm and preferably of less than 0.1 μm, so that the filler particularly preferably has a uniform, finely crystalline distribution in the matrix material. Such a finely crystalline distribution can for example be achieved by mixing an oxidizing agent with a powder of an alloy with the matrix material and with the metal forming the basis of the filler, as a result of which the metal which forms the basis of the filler and is present in the powder particles is oxidized. The desired components can then be manufactured, for example by pressing and sintering the matrix material-oxide composite powder thus produced.

In a further embodiment, the proportion of the filler in the matrix material is less than or equal to 2%, wherein the proportion can in particular be measured in % by weight. It has proven to be advantageous if the proportion of the filler in the matrix material is less than or equal to 1% or even less than or equal to 0.3%. In addition, the proportion of the filler in the matrix material can be greater than or equal to 0.2%.

It has been found that the addition of the filler to the matrix material, which can improve the mechanical properties of the matrix material in particular in the event of high thermal stress, also results in a very low tendency toward welding when used in particular in switching devices filled with hydrogen-containing gas. Thus, as a result of the metal matrix composite material described here, the problem of the tendency toward welding of the contacts in the switching device described here—which particularly preferably is a switching device filled with hydrogen-containing gas—is reduced or even solved completely by the addition, for one or more of the contacts, of a small amount of a high-melting, very stable metal oxide to a metal material, preferably to a copper material. The preferably fine distribution of the particulate filler can in particular increase the mechanical strength of the metallic matrix material without impairing the thermal or electrical conductivity thereof. In particular, tests using the switching device described herein have shown that more switching operations at a current to be switched of more than 100 A can be achieved by the metal matrix composite material without "sticking", that is to say without welding of the contacts, than when using conventional contact materials not corresponding to the metal matrix composite material described herein.

Particularly preferably, at least the movable contact can include the metal matrix composite material. In particular, at least the movable contact can be formed completely from the metal matrix composite material. As an alternative or in addition, the at least one fixed contact can also include the metal matrix composite material or be formed completely therefrom. If the switching device has at least two fixed contacts, preferably all fixed contacts of the switching device can include the metal matrix composite material or be each formed completely therefrom. It may be particularly preferable if all contacts, that is to say all fixed and movable contacts of the switching device, include the metal matrix composite material or are each formed completely therefrom.

If a contact includes the metal matrix composite material, this can also meant that the contact has a contact body and at least one contact region fixed to the contact body and the at least one contact region includes the metal matrix composite material. The contact body can be manufactured from a metal material, for example the metallic matrix material, that is to say for instance copper or a copper alloy, without any embedded filler. The contact region can for example be designed as a small plate, for example having a thickness of 1 mm or less and typically having a thickness of about 0.5 mm, and can be attached to the contact body. By way of example, a contact region, that is to say for example a small contact plate, may be attached to the contact body by brazing, riveting, caulking or another suitable method. Particularly preferably, all contacts can also have corresponding contact bodies and contact regions. Moreover, it may also be possible that for example the movable contact is formed completely from the metal matrix composite material, whereas the fixed contact or contacts is or are formed in each case by a contact body having a contact region which is formed by the metal matrix composite material and is arranged on said contact body. An inverse implementation is likewise possible.

BRIEF DESCRIPTION OF THE DRAWINGS

Further advantages, advantageous embodiments and developments emerge from the exemplary embodiments described hereinafter in conjunction with the figures.

In the figures.

DETAILED DESCRIPTION OF ILLUSTRATIVE EMBODIMENTS

In the exemplary embodiments and figures, identical, similar or identically functioning elements may each be provided with the same reference signs. The elements illustrated and their proportions with respect to each other should not be considered to be true to scale, instead individual elements such as for example layers, parts, components and regions may be illustrated to be disproportionately large for the purposes of improved presentability and/or for the purposes of better understanding.

Figure 1A:
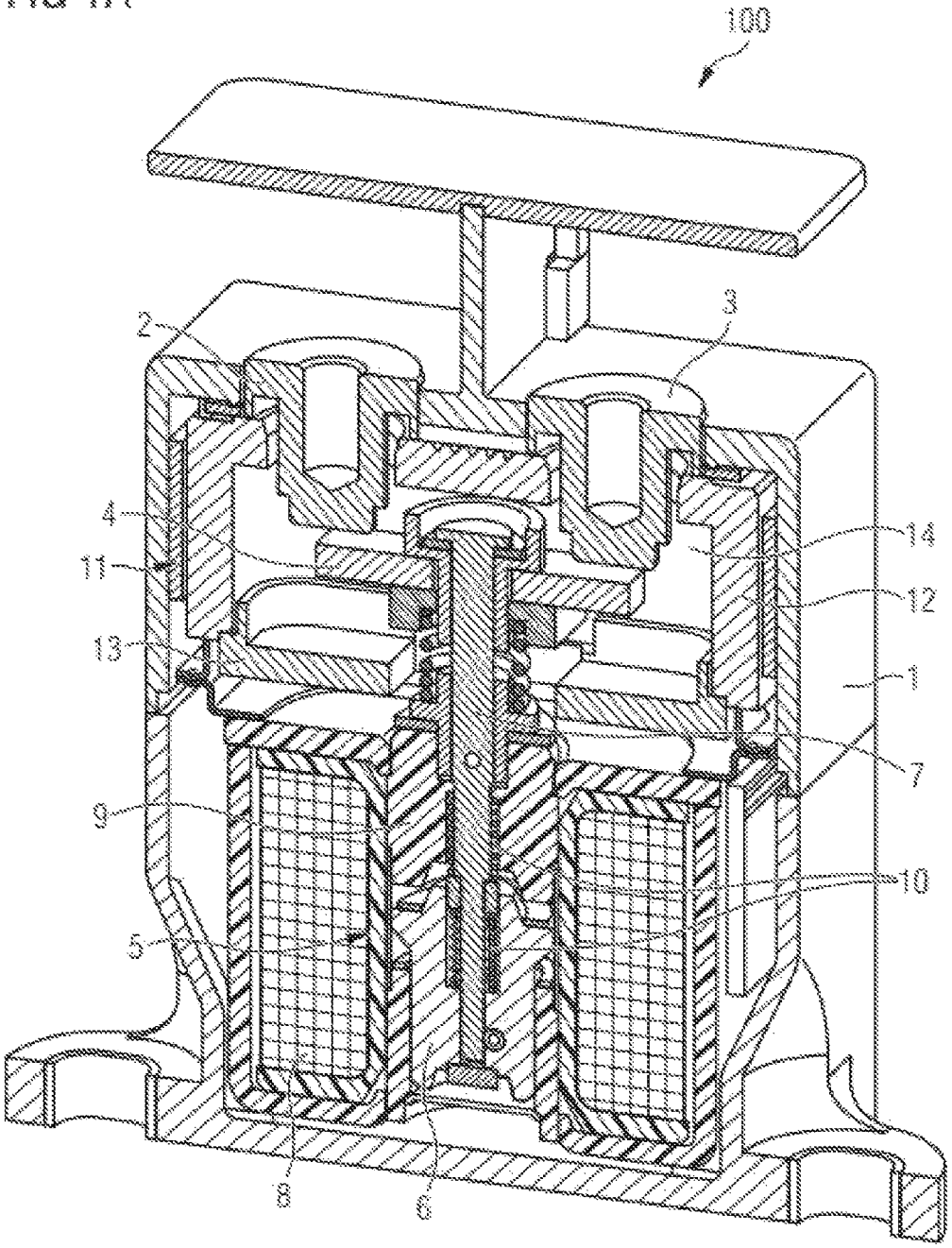
FIGS. 1A and 1B show schematic illustrations of a switching device according to an exemplary embodiment.
Figure 1B:
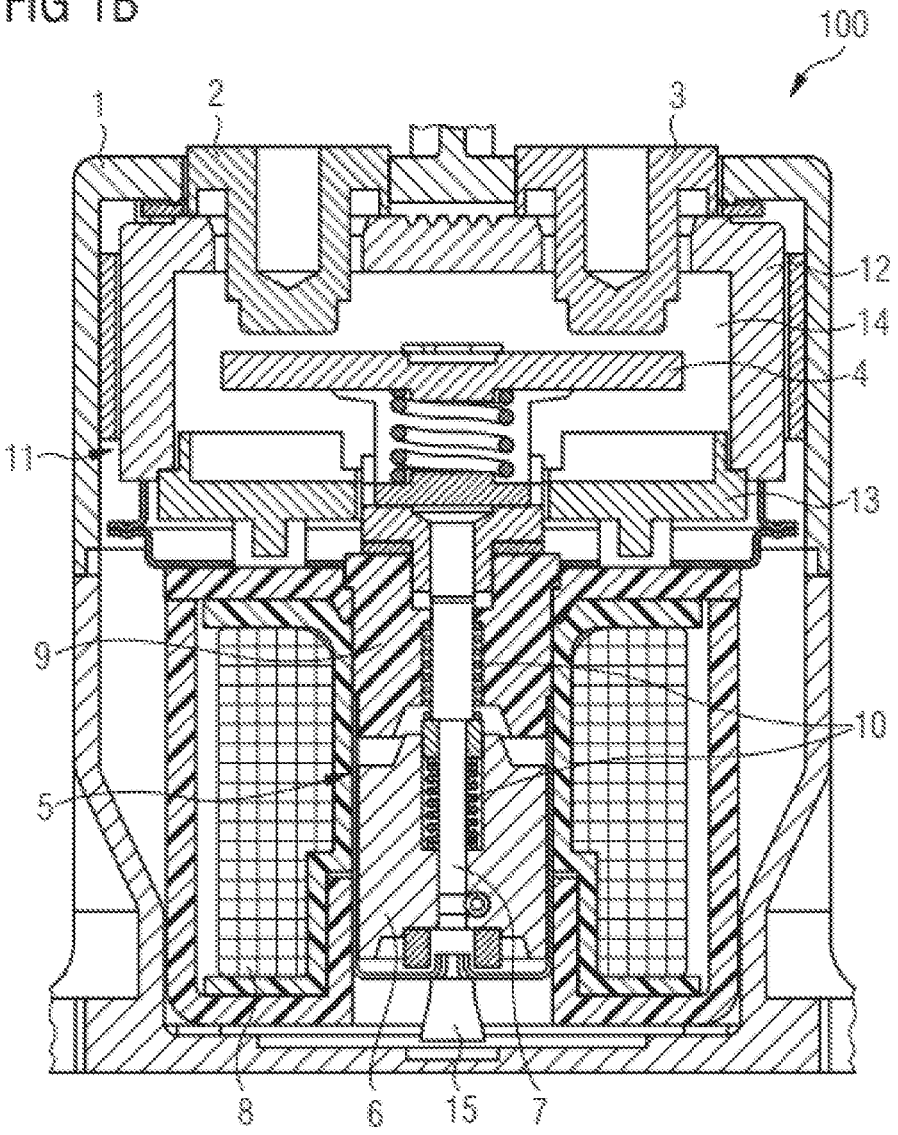

FIGS. 1A and 1B show an exemplary embodiment for a switching device 100 which may for example be used for switching high electric currents and/or high electric voltages and which may be a relay or a contactor, in particular a power contactor. FIG. 1A shows a three-dimensional sectional illustration, whereas FIG. 1B shows a two-dimensional sectional illustration. The description which follows relates equally to FIGS. 1A and 1B. The geometries shown should be understood merely as examples and in a non-limiting manner, and may also be designed in an alternative manner.

The switching device 100 has in a housing 1 two fixed contacts 2, 3 and a movable contact 4. The movable contact 4 is designed as a contact plate. The fixed contacts 2, 3 together with the movable contact 4 form the switching contacts. The housing 1 serves primarily as protection against contact with the components arranged in the interior and includes or is made of a plastic, for example polybutylene terephthalate (PBT) or glass-filled PBT.

FIGS. 1A and 1B show the switching device 100 in an inactive state in which the movable contact 4 is spaced apart from the fixed contacts 2, 3 so that the contacts 2, 3, 4 are galvanically isolated from each other. The design shown for the switching contacts and in particular the geometry thereof should be understood purely as examples and in a non-limiting manner. As an alternative, the switching contacts may also be designed differently. For example, it may be possible for just one of the switching contacts to be designed to be fixed.

The switching device 100 has a movable magnet armature 5 which essentially performs the switching movement. The magnet armature 5 has a magnetic core 6, for example including or made of a ferromagnetic material. The magnet armature 5 furthermore has a shaft 7 which is guided through the magnetic core 6 and at a shaft end is fixedly connected to the magnetic core 6. At the other shaft end lying opposite the magnetic core 6, the magnet armature 5 has the movable contact 4, which is likewise connected to the shaft 7. The shaft 7 can for example be manufactured with or from stainless steel.

The magnetic core 6 is surrounded by a coil 8. A current flow, which can be introduced from outside, in the coil 8 generates a movement of the magnetic core 6 and hence of the entire magnet armature 5 in an axial direction until the movable contact 4 contacts the fixed contacts 2, 3. The magnet armature 5 thus moves from a first position which corresponds to the inactive state and simultaneously to the isolating, that is to say non-switched-through state, to a second position which corresponds to the active, that is to say switched-through state. In the active state the contacts 2, 3, 4 are galvanically connected to each other. In another embodiment, the magnet armature 5 may alternatively also execute a rotary movement. The magnet armature 5 can in particular be designed as a tie rod or as a hinged armature. For guiding the shaft 7 and hence the magnet armature 5, the switching device 100 has a yoke 9 which may include or be made of pure iron or a low-doped iron alloy and which forms part of the magnetic circuit. The yoke 9 has an opening in which the shaft 7 is guided. If the current flow in the coil 8 is interrupted, the magnet armature 5 is moved back into the first position by one or more springs 10. The switching device 100 is then situated back in the inactive state in which the contacts 2, 3, 4 are open.

When the contacts 2, 3, 4 are opened, an arc may be formed which can damage the contact surfaces. There may as a result be a risk that the contacts 2, 3, 4 remain "stuck" to one another because of the welding caused by the arc, and can no longer be separated from each other. In order to prevent the formation of such arcs, or at the least to facilitate the extinguishing of arcs which occur, the contacts 2, 3, 4 are, firstly, arranged in a gas atmosphere, meaning that the switching device 100 is designed as a gas-filled relay or gas-filled contactor. Secondly, at least one of the contacts 2, 3, 4 includes a material which exhibits a low or no tendency toward welding.

With regard to the gas atmosphere, the contacts 2, 3, 4 are arranged within a switching chamber 11, formed by a switching chamber wall 12 and a switching chamber base 13, in a hermetically sealed portion of the housing 1. The housing 1, and especially the hermetically sealed portion of the housing 1, completely surrounds the magnet armature 5 and the contacts 2, 3, 4. The hermetically sealed portion of the housing and hence also the switching chamber 11 are filled with a gas 14. The gas 14, which can be introduced via a gas filling port 15 within the scope of the production of the switching device 100, can particularly preferably contain hydrogen, particularly preferably with 50% or more $H_2$ in an inert gas or even with 100% $H_2$, since hydrogen-containing gas can promote the extinguishing of arcs. If the proportion of $H_2$ in the gas 14 is less than 100%, the gas can additionally include one or more inert gases, in particular selected from $N_2$ and noble gases. In addition, inside and outside of the switching chamber 11 there may also be present so-called blowout magnets (not shown), that is to say permanent magnets which can bring about a prolongation of the arc path and can thus improve the extinguishing of the arc. The switching chamber wall 12 and the switching chamber base 13 can for example be manufactured with or from a metal oxide such as $Al_2O_3$.

At least one of the contacts 2, 3, 4 includes a metal matrix composite material comprising a metallic matrix material and a filler dispersed within the matrix material. The metal matrix composite material can particularly preferably include copper or a copper alloy as the matrix material, with the result that the metal matrix composite material can have a high electrical conductivity and accordingly a high current carrying capacity.

The filler includes a metal oxide or is formed of a metal oxide. Particularly preferably, a high-melting, very stable metal oxide is used for this purpose, for example aluminum oxide or a mixture of ceramic oxides with aluminum oxide. As an alternative to aluminum oxide, the filler can also include at least one or more other ceramic oxides. The filler is dispersed within the matrix material in the form of particles. The filler is particularly preferably uniformly and homogeneously distributed in the matrix material, with the particles having an average size of less than 1 μm and preferably of less than 0.1 μm. It has been found that the proportion of the filler in the matrix material is preferably less than or equal to 2% by weight. The proportion of the filler in the matrix material is particularly preferably less than or equal to 1% by weight or even less than or equal to 0.3% by weight and greater than or equal to 0.2% by weight.

By way of the addition of the filler to the metallic matrix material, a metal matrix composite material can be formed which compared to the pure matrix material has an increased mechanical strength for the same or essentially the same thermal and electrical conductivity. As has surprisingly been found, the metal matrix composite material also has a very low tendency toward welding, in particular in hydrogen-filled switching devices.

Particularly preferably, all contacts 2, 3, 4, that is to say all fixed and movable contacts of the switching device 100, can include the metal matrix composite material or even in each case be formed completely therefrom. This makes it possible to obtain the advantageous effects of the metal matrix composite material for all contacts 2, 3, and 4.

However, it may also be possible that only one of the contacts, for example the movable contact 4, includes the metal matrix composite material or preferably is formed completely therefrom. The fixed contacts 2, 3 may in this case include or be made of a conventional contact material, for example Cu, a Cu alloy or a mixture of copper with at least one further metal, for example Wo, Ni and/or Cr. As an alternative to this, it may also be possible that the movable contact 4 is manufactured from a conventional contact material and at least one or all of the fixed contacts 2, 3 include the metal matrix composite material or are preferably formed completely therefrom.

Figure 2A:
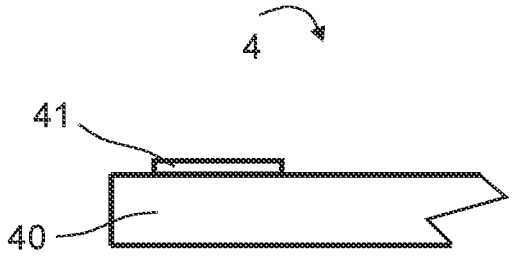
FIGS. 2A and 2B show schematic illustrations of portions of contacts of switching devices according to further exemplary embodiments.
Figure 2B:
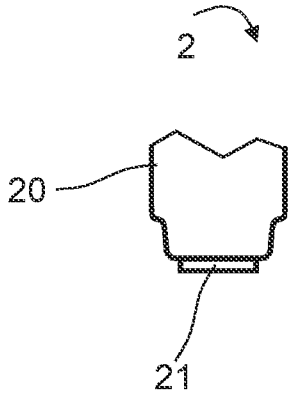

As an alternative to the complete formation of one or more contacts 2, 3, 4 from the metal matrix composite material, the contact or contacts may for example include the metal matrix composite material only in a contact region. The contact region is fixed to a contact body which is formed by a conventional contact material. The contact region of a contact is the region by way of which the contact in the active state of the switching device makes contact with the other contact provided for the switching operation. FIG. 2A shows an excerpt of an exemplary embodiment for a corresponding movable contact 4 having a contact body 40 made from a conventional contact material and a contact region 41 made from the metal matrix composite material, whereas FIG. 2B shows an excerpt of an exemplary embodiment for a corresponding fixed contact 2 having a contact body 20 made from a conventional contact material and a contact region 21 made of the metal matrix composite material.

The contact regions 21, 41 may each be designed as plates, for example having a typical thickness of about 0.5 mm, and can be attached to the respective contact body 20, 40 for example by brazing, riveting or caulking. It may be possible that all contacts 2, 3, 4 are designed accordingly. As an alternative, it may for example also be possible that for example the fixed contacts are designed corresponding to the exemplary embodiment of FIG. 2B, whereas the movable contact is made from a conventional contact material or, particularly preferably, is formed from the metal matrix composite material. The inverse design is likewise possible, that is to say the design of the movable contact 4 according to the exemplary embodiment of FIG. 2A, while the fixed contacts 2, 3 are formed from a conventional contact material or, particularly preferably, from the metal matrix composite material.

The features and exemplary embodiments described in conjunction with the figures can be combined with one another according to further exemplary embodiments, even if not all combinations have been explicitly described. Furthermore, the exemplary embodiments described in conjunction with the figures may alternatively or additionally include further features in accordance with the description in the general part.

The invention is not restricted to the exemplary embodiments by the description on the basis of said exemplary embodiments. Rather, the invention encompasses any novel feature and any combination of features, which in particular includes any combination of features in the patent claims, even if this feature or this combination is not itself explicitly specified in the patent claims or exemplary embodiments.

The invention claimed is:

1. A switching device comprising:

at least two fixed contacts; and at least one movable continuous contact bridge configured to mechanically contact each of the two fixed contacts in an active state, wherein the two fixed contacts and the contact bridge are arranged in a switching chamber configured to contain a gas comprising $H_2$, and wherein one fixed contact of the two fixed contacts and the contact bridge are formed completely from a metal matrix composite material comprising a metallic matrix material and a filler dispersed within the metallic matrix material.

2. The switching device according to claim 1, wherein another fixed contact of the two fixed contacts includes the metal matrix composite material.

3. The switching device according to claim 1, wherein the metal matrix composite material includes copper or a copper alloy as the metallic matrix material.

4. The switching device according to claim 1, wherein the filler includes a metal oxide.

5. The switching device according to claim 1, wherein the filler includes an oxide comprising aluminum.

6. The switching device according to claim 1, wherein the filler is formed of particles.

7. The switching device according to claim 6, wherein the particles have an average size of less than 1 μm.

8. The switching device according to claim 6, wherein the particles have an average size of less than or equal to 0.1 μm.

9. The switching device according to claim 1, wherein the proportion of the filler in the matrix material is less than or equal to 2 wt. %.

10. The switching device according to claim 1, wherein the proportion of the filler in the matrix material is less than or equal to 1 wt. %.

11. The switching device according to claim 1, wherein the proportion of the filler in the matrix material is less than or equal to 0.3 wt. %.

12. The switching device according to claim 1, wherein the proportion of the filler in the matrix material is greater than or equal to 0.2 wt. %.

13. The switching device according to claim 1, wherein the gas has a content of at least 50% $H_2$.

14. The switching device according to claim 1, wherein the contact bridge is a contact plate.

15. The switching device according to claim 1, wherein a shaft of a magnet armature is connected to and reaches through an opening in the contact bridge.

16. A switching device comprising:

at least two fixed contacts; and at least one movable continuous contact bridge configured to mechanically contact each of the two fixed contacts in an active state, wherein at least one of the contacts includes a metal matrix composite material comprising a metallic matrix material and a filler dispersed within the metallic matrix material, wherein the contacts are arranged in a switching chamber configured to contain a gas comprising $H_2$, and wherein the movable contact bridge is formed completely from the metal matrix composite material.

17. The switching device according to claim 16, wherein the fixed contacts include the metal matrix composite material.

18. The switching device according to claim 16 , wherein the metal matrix composite material includes copper or a copper alloy as the metallic matrix material.

19. The switching device according to claim 18, wherein the filler includes a metal oxide.

20. The switching device according to claim 18, wherein the filler includes an oxide comprising aluminum.

21. The switching device according to claim 18, wherein the filler is formed of particles.

22. The switching device according to claim 21 , wherein the particles have an average size of less than 1 μm.

23. The switching device according to claim 16, wherein the contact bridge is a contact plate.

* * * * *